US006281456B1

(12) United States Patent
Ogden

(10) Patent No.: US 6,281,456 B1
(45) **Date of Patent: *Aug. 28, 2001**

(54) THREE-AXIS GRAVITY SWITCH

(75) Inventor: Everett Ogden, Ponte Vedra Bch., FL (US)

(73) Assignee: Par Technology, Inc., Ponte Vedra Beach, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/247,266

(22) Filed: Feb. 10, 1999

Related U.S. Application Data

(60) Provisional application No. 60/074,286, filed on Feb. 11, 1998.

(51) Int. Cl.[7] ..... H01H 29/20

(52) U.S. Cl. ..... 200/61.46; 33/366.11; 33/366.24; 200/61.47; 200/189; 473/257

(58) Field of Search ..... 200/187, 189, 200/223, 224, 80 A, 61.46, 61.47; 473/221, 223, 226, 257; 33/508, 366.11, 366.15, 366.24

(56) References Cited

U.S. PATENT DOCUMENTS

| | | | | |
|---|---|---|---|---|
| 2,465,066 | * | 3/1949 | Corliss | 200/187 |
| 3,673,697 | * | 7/1972 | Wasson | 33/370 X |
| 3,836,739 | * | 9/1974 | Endo | 200/61.47 |
| 4,445,011 | * | 4/1984 | Hansen | 200/185 X |
| 4,565,010 | * | 1/1986 | Herman | 33/366.24 |

* cited by examiner

*Primary Examiner*—Renee Luebke
(74) *Attorney, Agent, or Firm*—Thomas C. Saitta

(57) ABSTRACT

A three-axis gravity switch having a curved chamber to retain a gravity responsive member such as a ball of liquid mercury, the chamber having a three-dimensional pathway defined on at least one of its walls, where the gravity responsive member and pathway are conductive, either electrically or optically, such that a circuit is completed when the gravity responsive member contacts the pathway, where the switch can be rotated, inverted and translated in three dimensions such that the pathway defines an acceptable three dimensional course of rotation for the switch.

23 Claims, 3 Drawing Sheets

THREE-AXIS GRAVITY SWITCH

This application claims benefit of provisional application Ser. No. 60/074,286 filed Feb. 11, 1998.

BACKGROUND OF THE INVENTION

This invention relates to sensors or switches which utilize the fact that gravity will maintain an unrestricted conductive contact element, such as a metal ball or ball of liquid mercury, in the lowermost position relative to its containment chamber to indicate attitudinal position of the switch or sensor relative to true vertical, and correspondingly the attitudinal position of any object attached thereto. More particularly, the invention is a sensor which is able to monitor the attitudinal position of an object relative to true vertical over a three axis pathway, such that a single sensor can monitor the movement over the pathway even if the object and sensor are inverted or tilted in any plane, and regardless of whether the object is fixed in space or moved positionally. Even more particularly, the invention relates to such a sensor having a sensing pathway defined on all or part of a spherical or multiply curved surface.

There are many situations where it is necessary or desired to monitor or sense the attitudinal position of an object relative to true vertical. Switches or sensors which utilize the effect of gravity on a ball of liquid mercury or an electrically conductive metal ball or roller are well known, the switch being designed such that the unrestricted conductive member makes or loses contact with a pair of leads in an electrical circuit dependent on the attitude of the switch relative to true horizontal, such that contact with the leads or loss of contact with the leads which occurs when the attitudinal position of the switch is altered relative to vertical results in a signal or other electrical action occurring. Such switches or sensors are commonly referred to as mercury or gravity switches. Such simple gravity switches work when the object or switch is rotated about a non-vertical line, such that the switch is activated or deactivated when a particular angle relative to vertical is exceeded and gravity causes movement of the conducting ball away from or against the contact leads. In order to track attitudinal positioning of an object along various curved pathways in the X-Y-Z three axis world, where the switch is rotated, tilted and/or inverted, the known solution is to attempt to combine a number of such two dimensional switches. Any such solution, especially when the object is inverted, requires determination of sequential activation and deactivation scenarios, since certain of the switches will be non-functional or provide incorrect signals when the object passes through various positions relative to vertical.

It is an object of this invention to provide a single gravity-type sensor switch which monitors the position of an object over a three dimensional pathway which extends dimensionally about all three axes where the object may be tilted, rotated or inverted, as well as translated through space rather than focused on a fixed location, so as to provide a signal to indicate that the object is moving in the correct three dimensional manner. It is a further object to provide such a switch which contains a gravity controlled contact member which remains at the bottom of the sensor because of gravity as the position of the sensor changes relative to true vertical, where the sensor comprises a curved contact pathway corresponding to the desired three dimensional movement path of the object, where the contact member is contained within a curved tube or a pair of matching curved surfaces which can be part or all of a sphere, a combination of multiple curved surfaces or of any three dimensional curvilinear pathway in space.

SUMMARY OF THE INVENTION

The invention is a gravity-type sensor switch where a gravity responsive member remains in the lowermost portion of a retaining chamber as the switch is moved through space. The gravity responsive member, which may be ball of liquid mercury, an electrically conductive solid metal ball or roller, or similar type object, is retained within a defined curvilinear chamber having at least one conductive pathway mounted along one of the walls of the chamber which allows for relative movement between the gravity responsive member and the pathway as the attitudinal position of the switch relative to true vertical changes, true vertical being defined as the line passing through the switch and the gravitational center of the earth. A sensing pathway is formed along the curved walls such that a completed electrical circuit is produced when the gravity responsive member is in proper contact with the sensing pathway. The sensing pathway may comprise a number of discrete contact lead pairs positioned along the pathway, or it may comprise a pair of continuous conductive strips or wires. The chamber walls may comprise the interior wall of a curved tube or a pair of curvilinear, equidistantly spaced walls having matching surfaces. The wall pairs may comprise a sphere within a sphere, a section of a sphere within a sphere, or any configuration of paired curvilinear walls. The curved tube may comprise a portion of a circle or may be spiraled or curved in multiple curves of differing radii.

The sensing pathway occupies at least two dimensions and enables the sensor to function regardless of tilt, rotation or inversion. The particular sensing pathway is determined by the desired positional movement of the object to be monitored. The zero position, defined to be the position of the gravity responsive member relative to the remaining components of the sensor at any moment in the movement path of the object, i.e., the lowest possible position for the gravity responsive member within the retaining walls for a given attitudinal position, is determined for the object's entire movement pathway. With this information, the proper sensing pathway can be constructed on the chamber walls so that as the object is moved through three dimensions, the sensor pathway will be repositioned relative to the gravity responsive member, which has a fixed spatial attitude due to gravity. As long as the object is moved in the correct pathway, the gravity responsive member will remain in contact with the sensing pathway and the electrical circuit will be maintained. If the object is moved out of the predetermined pathway, the contact element will not remain in contact with the sensing pathway and the circuit will be broken. Alternatively, the sensor can be designed such that movement in the proper pathway results in no contact with the contacting element, with the sensing pathways arranged to provide a complete circuit only when the object is incorrectly moved. The presence or absence of an electrical circuit is used to provide a signal or indication, or can be used to actuate other electrical devices to effect desired results.

The switch may also be constructed using optical components such as a combination of photosensors and defined light sources, receivers and emitters, whereby the gravity responsive element becomes an opaque blocking element between the light sources and the photosensors when properly positioned.

DETAILED DESCRIPTION OF THE INVENTION

Figure 1:
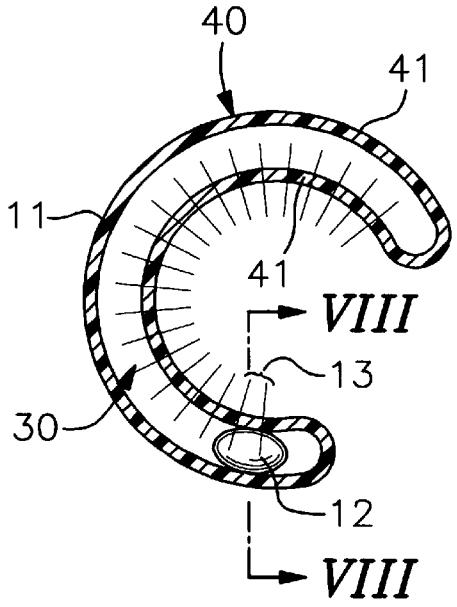
FIG. 1 is view of the tubular embodiment of the invention, showing the contact pathway as a series of discrete lead pairs.

The invention will now be described in detail with regard for the best mode and preferred embodiment, reference being made to the accompanying drawings. In general, the invention comprises a switch, or when in combination with suitable power and signal or control elements, a sensor, having a chamber 40 having opposing curved walls 41 to retain a gravity responsive member 12 which is free to move within the chamber 40, a gravity responsive member 12 which occupies the lowermost position in the chamber 40, and a conductive sensing pathway 30 along at least one of chamber walls 41 and typically on opposing walls 41, the pathway 30 extending in three dimensions, where the pathway 30 defines a course of rotation over all three axes for the switch such that the gravity responsive member 12, dependent on the orientation of the switch relative to true vertical, either contacts or does not contact the pathway 30, thus either completing or opening a circuit.

As seen in FIGS. 1 through 6 and 8 through 9, the switch comprises a tubular member 11 with closed ends which define curved opposing walls to retain the gravity responsive member 12. Tubular member 11 is preferably constructed of nonconducting material such as plastic. The gravity responsive member 12 is a conductive member, preferably consisting of a ball of liquid mercury, but the device may also be constructed using an electrically conductive metal ball or roller, or like object, which completes an electrical circuit when in contact with a conductive sensing pathway 30.

Figure 3:
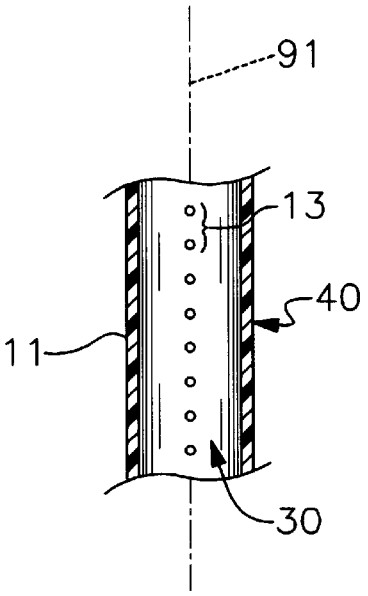
FIG. 3 is a cross-sectional view of a section of FIG. 1, showing the sensing pathway as positioned on the radial line.
Figure 8:
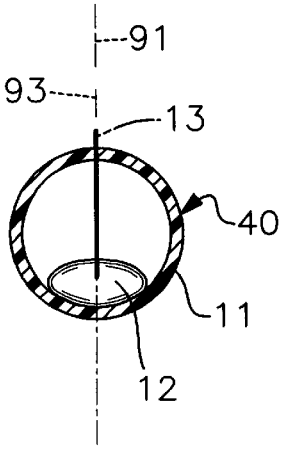
FIG. 8 is a cross-sectional view taken along line VIII—VIII of FIG. 1, showing the positioning of the gravity responsive member relative to the sensing pathway when the sensing switch is maintained in the proper position.
Figure 9:
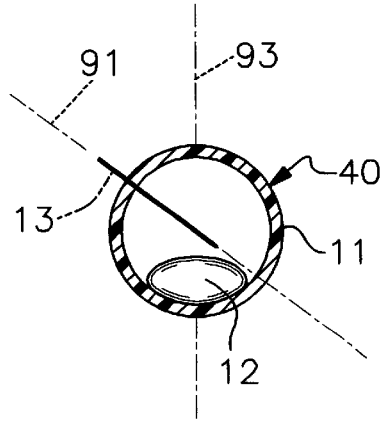
FIG. 9 is a cross-sectional view similar to FIG. 8 showing the positioning of the gravity responsive member relative to the sensing pathway when the sensing switch is tilted beyond the proper positional alignment.

FIGS. 1 and 3 illustrate a simple version of the sensor switch, where the pathway 30 comprises paired pin contact electrical lead members 13 extending into the interior of the chamber 40 through a curved wall 41, which although not shown would be arranged in circuit with an electrical power source, such as a battery, such that when the gap between any paired set of electrical leads 13 is closed by contact of the gravity responsive member 12, the current will flow to produce a desired electrical response, such as a signal or indication. The electrical leads 13 are arranged along the radial line 91 taken from the midpoint of the circle enclosed by tubular chamber 40 which bisects the chamber 40, as shown in FIG. 3. The radial line 91 and thus the conductive pathway 30 is in the plane of the circle. As the switch is rotated about its central axis, the gravity responsive member 12 remains at the lowermost position relative to true vertical 93, and successive pairs of leads 13 come into contact with the gravity responsive member 12 so long as the switch, and the object to which the switch is attached, is rotated within the vertical plane, as shown in FIG. 8. If however the switch is tilted out of the proper plane of rotation, then the gravity responsive member 12 will no longer contact the leads 13 and the electrical circuit will be broken, as shown in FIG. 9.

Figure 2:
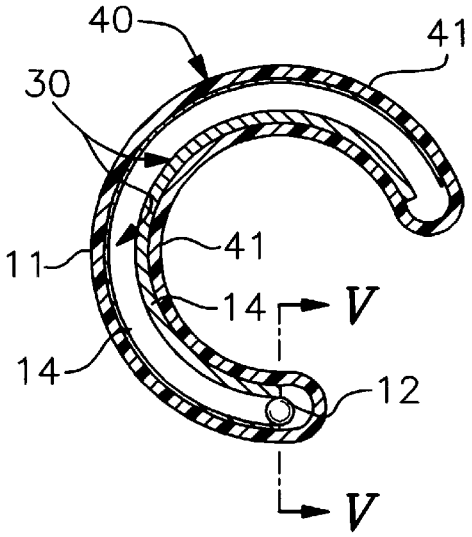
FIG. 2 is a view of the tubular embodiment showing the sensing pathway as a pair of opposing conductive strips.
Figure 5:
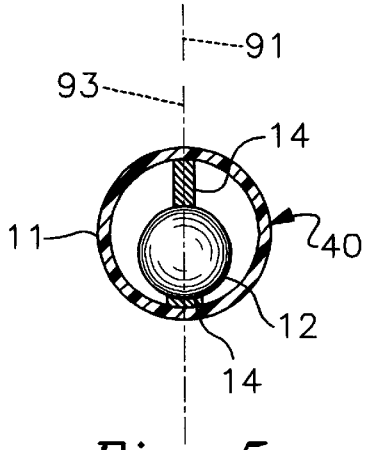
FIG. 5 is a cross-sectional view taken along line V—V of FIG. 2, showing the positioning of the gravity responsive member relative to the sensing pathway when the sensing switch is maintained in the proper position.
Figure 6:
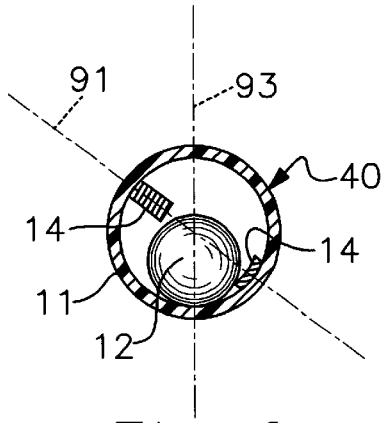
FIG. 6 is a cross-sectional view similar to FIG. 5 showing the positioning of the gravity responsive member relative to the sensing pathway when the sensing switch is tilted beyond the proper positional alignment.

FIG. 2 shows an alternative embodiment, where the sensing pathway 30 is formed by a set of opposing strips 14 which extend out from the opposing curved walls 41 of the chamber 40. Here the opposing strips 14 would be connected in a powered electrical circuit, not shown, such that a closed electrical circuit is created from one strip 14 to the opposing contact strip 14 through gravity responsive element 12, a metal ball. FIGS. 5 and 6 illustrate respectively a closed electrical circuit with the sensing switch maintained in the proper alignment and an open electrical circuit when the switch is tilted improperly such that contact between the conductive pathway 30 and the gravity responsive element 12 is broken.

Figure 4:
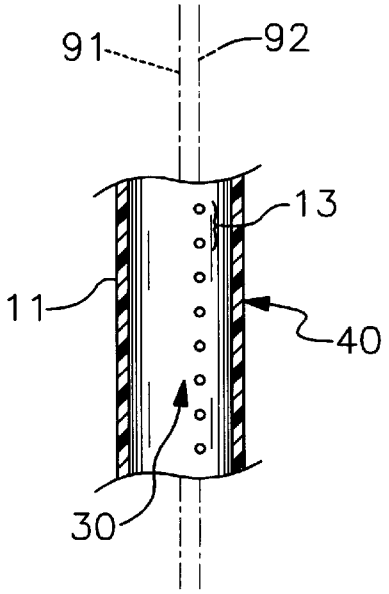
FIG. 4 is a view similar to FIG. 3, showing the sensing pathway as positioned some degrees off the radial line.
Figure 10:
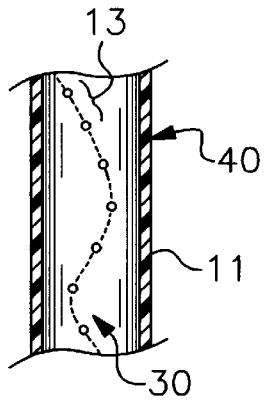
FIG. 10 is a view similar to FIG. 3, where the sensing pathway is curvilinear and formed of electrical lead pairs.
Figure 11:
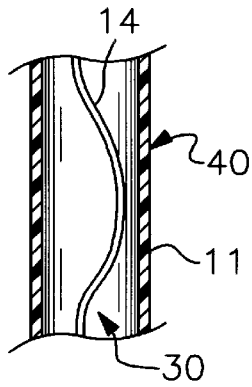
FIG. 11 is a view similar to FIG. 3, where the sensing pathway is curvilinear and formed of a conductive strip material.
Figure 12:
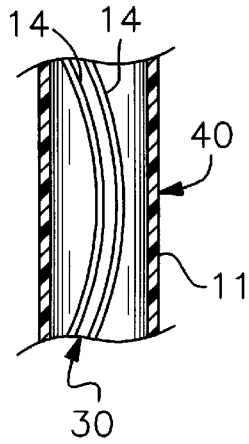
FIG. 12 is a view similar to FIG. 3, where the sensing pathway is a pair of curvilinear strips.
Figure 13:
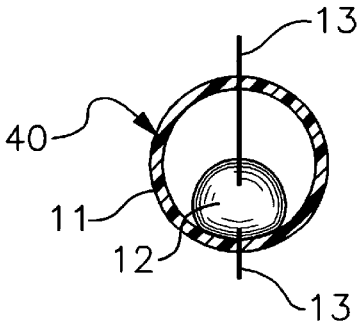
FIG. 13 is a view similar to FIG. 3, showing electrical contact leads positioned on opposing walls.

As depicted in FIGS. 1 and 2, the switch can be rotated approximately 225 degrees without loss of function. The tubular member 11 could be constructed of shorter or longer arc lengths, and could even be configured as a full 360 degree ring. This embodiment functions to sense attitudinal position relative to true vertical 93. The sensitivity of the switch, i.e., the angular variation allowed from true vertical before electrical contact is broken is determined by the length of the extension of the contact leads 13 into the interior of the tube 11.

Where the desired movement pathway of the object is planar but not vertical, as in the case of a golf swing, the placement of the contact leads 13 is altered as shown in FIG. 4. For example, a proper golf swing for any of the full distance shots requires that the club be rotated approximately 270 degrees from a zero degree starting position with the club held straight down, then brought backwards through horizontal, past vertical to an almost horizontal stopping point, with the swing pathway reversed in order to strike the ball. In addition, the swing plane is tilted from true vertical about 30 to 45 degrees and each portion of the club changes its position in space, i.e., there is no point on the club itself corresponding to a single fixed axis or fixed pivot point. Monitoring of the entire swing with regard for the proper swing plane is desirable to ensure that the swing is properly made. Here the leads 13 forming pathway 30 are not positioned along radial line 91 but instead are positioned along offset line 92, which is a predetermined number of degrees from radial line 91. With this construction, the proper movement pathway is on a slanted plane, and the sensing pathway 30 defined by the contact leads 13 mimics that plane relative to true vertical. If the switch is maintained at the proper alignment angle, even during inversion and position change through 270 degrees, the gravity responsive member 12 will remain in contact with the pathway 30 and an electrical circuit will be maintained.

Where the desired movement pathway is not planar but occurs over a three axis pathway, similar adjustments are made to the sensing pathway 30 along the length of the tubular member 11. Any sort of curving, spiraling or even abrupt angle change in the desired movement pathway is mimicked by the pathway 30, such that the sensing pathway 30 corresponds to the desired object movement pathway, such as shown in FIGS. 10 through 12. FIG. 12 shows the pathway 30 as formed by a pair of spaced conductive strips where the circuit is open when the switch is maintained in the proper position and closed should the gravity responsive member 12 contact either strip of pathway 30. In this manner the switch can be rotated, inverted and tilted through differing angles from true vertical. The gravity responsive member 12 remains at the gravity position throughout all the switch movement, and maintains the completed electrical circuit so long as it is in contact with the pathway 30.

Figure 7:
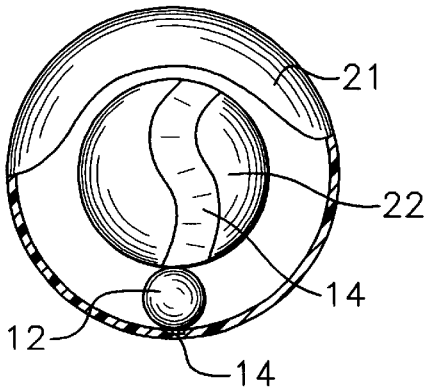
FIG. 7 is a partially exposed view of an embodiment of the invention where the pathway walls are formed by a pair of spherical surfaces.

In another alternative embodiment, shown in FIG. 7, the tubular member 11 is replaced by an inner spherical surface 22 inside an outer spherical surface 21, each defined as portions of a sphere. The gravity responsive member 12 will always remain at the lowermost gravity position as the switch is turned in any direction. As before, sensing pathway 30 is laid out to correspond to the desired movement pathway of the switch. The switch can be constructed with contact lead pins 13 and a liquid mercury contact element 12 as discussed above, or may be constructed as shown in the drawing using a pair of opposing contact strips 14 to form the pathway 30 with the circuit completed by a metal ball or liquid mercury gravity responsive member 12. If the switch is turned such that the gravity responsive member 12 does not contact both strips 14, the circuit will be broken. As before, any desired movement pathway can be replicated on the surfaces of 21 and 22.

Figure 14:
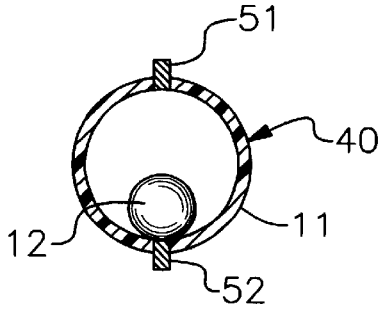
FIG. 14 is a view similar to FIG. 3, showing the pathway formed by optical emitters and receivers.

Another alternative embodiment for this type of sensing switch involves the use of optical circuits rather than electrical circuits, as shown in FIG. 14. The sensing pathway 30 is formed in the opposing walls 41 by oppositely positioned light emitting and light receiving elements 51 and 52, with the gravity responsive member 12 being an opaque ball acting to block light reception between oppositely mounted emitter 51 and receiver 52 when the switch is in the proper alignment, thus breaking the circuit.

Movement of the gravity responsive element 12 within the switch can be slowed or damped by the addition of oil or a similar fluid. The sensitivity of the switch is effected by the depth of the pathway 30 and the size of the gravity responsive element 12.

It is understood that certain substitutions and equivalents for elements set forth above may be obvious to those skilled in the art, and thus the true scope and definition of the invention is to be as set forth in the following claims.

I claim:

1. A gravity switch which controls a circuit in response to positioning the switch relative to true vertical comprising:

a chamber having opposing curved walls;

a non-planar conductive pathway along at least one of the chamber curved walls, said pathway extending in all three axial directions;

a gravity responsive member free to move within said chamber whereby said gravity responsive member, dependent on the orientation of said switch relative to true vertical, either contacts said pathway forming a closed or does not contact said pathway leaving an open circuit;

where said pathway defines a course of rotation for said switch over all three axial directions wherein said gravity responsive member remains in contact with said pathway to maintain said closed circuit throughout said course of rotation.

2. The switch of claim 1, where said conductive pathway is electrically conductive and said gravity responsive member is electrically conductive.

3. The switch of claim 2, where said conductive pathway comprises a plural number of paired electrical leads.

4. The switch of claim 3, where said paired electrical leads are positioned along a single curvilinear line.

5. The switch of claim 3, where said paired electrical leads are positioned along a pair of curvilinear lines, each of said curvilinear lines positioned on one of said opposing curved walls of said chamber, with one of each said paired electrical leads positioned on one of said curvilinear lines and the other of each said paired electrical leads positioned on the opposite of said curvilinear lines, where said gravity responsive member contacts said paired electrical leads to complete a circuit when said switch is oriented in a particular manner.

6. The switch of claim 2, where said conductive pathway comprises a pair of electrically conductive strips, each of said strips positioned on one of said opposing curved walls of said chamber, where said gravity responsive member contacts said strips to complete a circuit when said switch is oriented in a particular manner.

7. The switch of claim 2, where said gravity responsive member is liquid mercury.

8. The switch of claim 2, where said gravity responsive member is a metal ball.

9. The switch of claim 1, where said conductive pathway is optically conductive.

10. The switch of claim 9, where said conductive pathway comprises paired sets of light emitters and light receivers, where for each said emitter and receiver pair the emitter is positioned on one of said opposed curved walls of said chamber and the receiver is positioned on the opposite of said opposed curved walls of said chamber, and where said gravity responsive member is opaque so that contact with said pathway blocks light emitted from at least one said light emitter.

11. The switch of claim 1, where said chamber is a curved tube.

12. The switch of claim 1, where each of said opposing curved walls is defined by a portion of the surface of a sphere.

13. The switch of claim 1, where said opposing curved walls are separated by a constant distance throughout said chamber.

14. A gravity switch which controls a circuit in response to positioning the switch relative to true vertical comprising:

a closed chamber defined by a wall of a circular tube circular in cross-section;

a non-planar conductive pathway along said wall, said pathway extending in all three axial directions;

a gravity responsive member free to move within said chamber whereby said gravity responsive member, dependent on the orientation of said switch relative to true vertical, either contacts said pathway forming a closed circuit or does not contact said pathway leaving an open circuit;

where said pathway defines a course of rotation for said switch over all three axial directions wherein said gravity responsive member remains in contact with said pathway to maintain said closed circuit throughout said course of rotation.

15. The switch of claim 14, where said conductive pathway is electrically conductive and said gravity responsive member is electrically conductive.

16. The switch of claim 15, where said conductive pathway comprises a plural number of paired electrical leads.

17. The switch of claim 16, where said paired electrical leads are positioned along a single curvilinear line.

18. The switch of claim 16, where said paired electrical leads are positioned along a pair of curvilinear lines, said curvilinear lines positioned opposite each other, with one of each said paired electrical leads positioned on one of said curvilinear lines and the other of each said paired electrical leads positioned on the opposite of said curvilinear lines, where said gravity responsive member contacts said paired electrical leads to complete a circuit when said switch is oriented in a particular manner.

19. The switch of claim 15, where said conductive pathway comprises a pair of electrically conductive strips, said strips positioned opposite each other, where said gravity responsive member contacts said strips to complete a circuit when said switch is oriented in a particular manner.

20. The switch of claim 15, where said gravity responsive member is liquid mercury.

21. The switch of claim 15, where said gravity responsive member is a metal ball.

22. The switch of claim 14, where said conductive pathway is optically conductive.

23. The switch of claim 22, where said conductive pathway comprises paired sets of light emitters and light receivers, where for each said emitter and receiver pair the emitter is positioned opposite the receiver, and where said gravity responsive member is opaque so that contact with said pathway blocks light emitted from at least one said light emitter.

* * * * *